US005129238A

United States Patent [19]

Schwartz et al.

[11] Patent Number: 5,129,238

[45] Date of Patent: Jul. 14, 1992

[54] SOFT DRINK CONTAINER COOLER

[76] Inventors: James A. Schwartz, 615 Forest Glen Rd., Clearwater, Fla. 34615; Lawrence Shapiro, 5048 NW. 98th La., Coral Springs, Fla. 33076

[21] Appl. No.: 693,921

[22] Filed: Apr. 29, 1991

Related U.S. Application Data

[63] Continuation-in-part of Ser. No. 620,790, Nov. 30, 1990, abandoned.

[51] Int. Cl.[5] ..... F25D 3/08

[52] U.S. Cl. ..... 62/457.3; 62/530; 62/457.2; 220/904

[58] Field of Search ..... 62/457.1, 457.3, 529, 62/530, 400; 220/304, 90.4, 903; 229/1.5 B

[56] References Cited

U.S. PATENT DOCUMENTS 3,840,153 10/1974 Devlin ..... 222/180

5,009,083 4/1991 Spinos et al. ..... 62/457.3

*Primary Examiner*—Albert J. Makay
*Assistant Examiner*—John Sollecito

[57] ABSTRACT

A drinking container having a cylindrical side wall attached along threads at an external top portion to a screw on cap member sealed to the side wall to prevent leakage of fluid from the container. The cap member is integral with a freezable insert containing an aqueous solution with a downwardly descending freezable insert containing an aqueous solution with a freezing point below the freezing point of water. The freezable insert can have its contents frozen and then returned to a position within the cylindrical side wall of the container to cool a liquid placed within the container. Alternatively, the freezable insert is separate from the cap and is screwed into a central bore of the cap after being frozen.

2 Claims, 3 Drawing Sheets

SOFT DRINK CONTAINER COOLER

PRIOR APPLICATION

This application is a continuation-in-part of my application Ser. No. 07/620,790, filed Nov. 30, 1990 now abandoned.

BACKGROUND OF THE INVENTION

1. Field of The Invention.

This invention relates to hand held soft drink containers. More particularly, it refers to a replaceable frozen cartridge insert mounted in a soft drink container.

2. Description of The Prior Art.

Many types of devices are used to cool containers enclosing beverages. The most common device is an exterior enclosure around the container, the enclosure containing a freezable liquid or refrigerant as disclosed in U. S. Pat. Nos. 4,183,226; 4,338,795; 4,383,422; and 4,932,225. In addition, U. S. Pat. No. 4,741,176 describes a sealed capsule containing a refrigerant mounted within a cylindrical container. The capsule can be removed to freeze the contents and then remounted within the container. Although all of these prior art descriptions set forth devices for carrying out their intended purpose of cooling the container liquid contents, they suffer the penalty of either adding external bulk to the container or as in the case of U. S. Pat. No. 3,840,153, taking up so much space within the container as to limit the amount of liquid that can be stored within the container. A device is needed that will not add bulk to the container but will still enable a user to keep liquid within the container cool without the addition of ice.

SUMMARY OF THE INVENTION

This invention is the design of a hand held beverage container having a standard diameter, but having a separable cap member sealed to the top edge of a side wall of the container. The cap member has an integral freezable insert containing a non-toxic, non-volatile, aqueous solution with a freezing point below the freezing point of water. The cap member is removable to freeze the contents and then is resealed to the side wall of the container so that any subsequently added liquid is cooled. Alternatively, a freezable insert tube containing the non-toxic, non-volatile, aqueous solution is screwed to a threaded bore in the cap for the beverage container.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
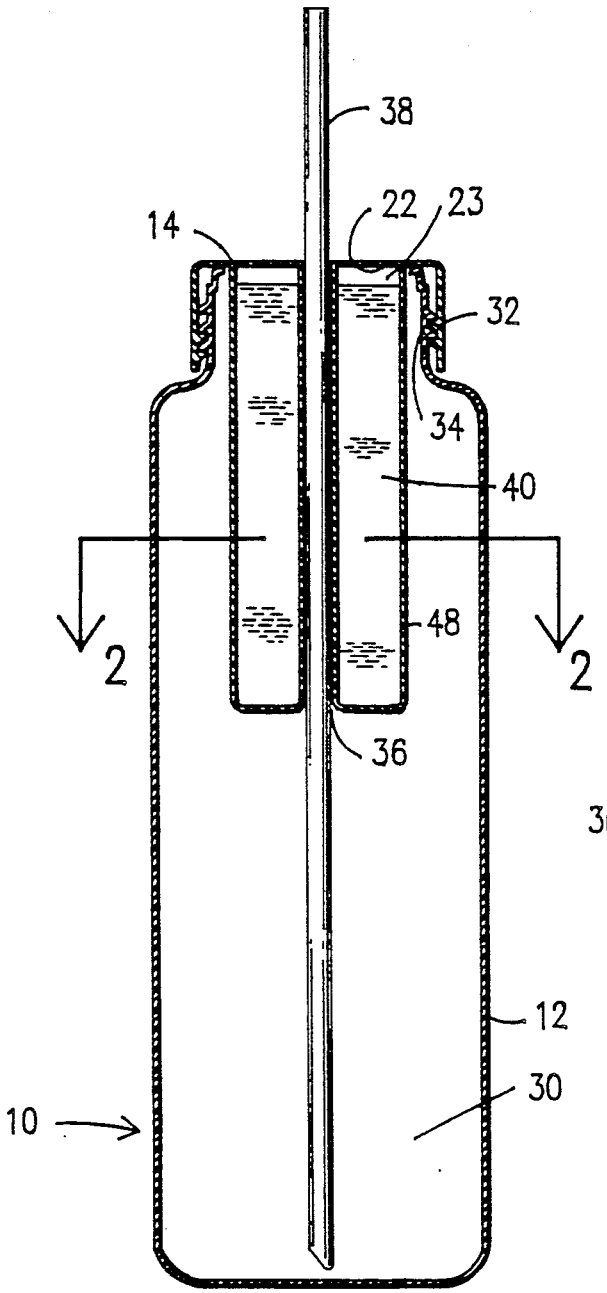
FIG. 1 is a sectional view in elevation of a container with a cap member containing a freezable solution engaged by threads to the container.
Figure 2:
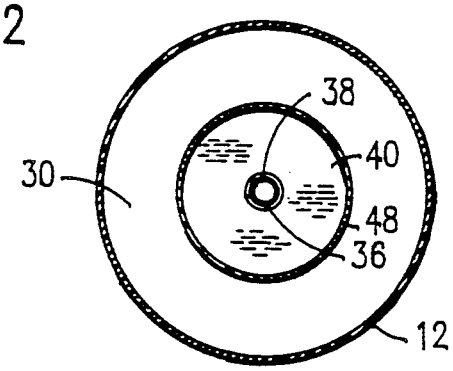
FIG. 2 is a cross-sectional view along line 2—2 of FIG. 1.

Throughout the following detailed description, the same reference numerals refer to the same elements in all figures.

Figure 3:
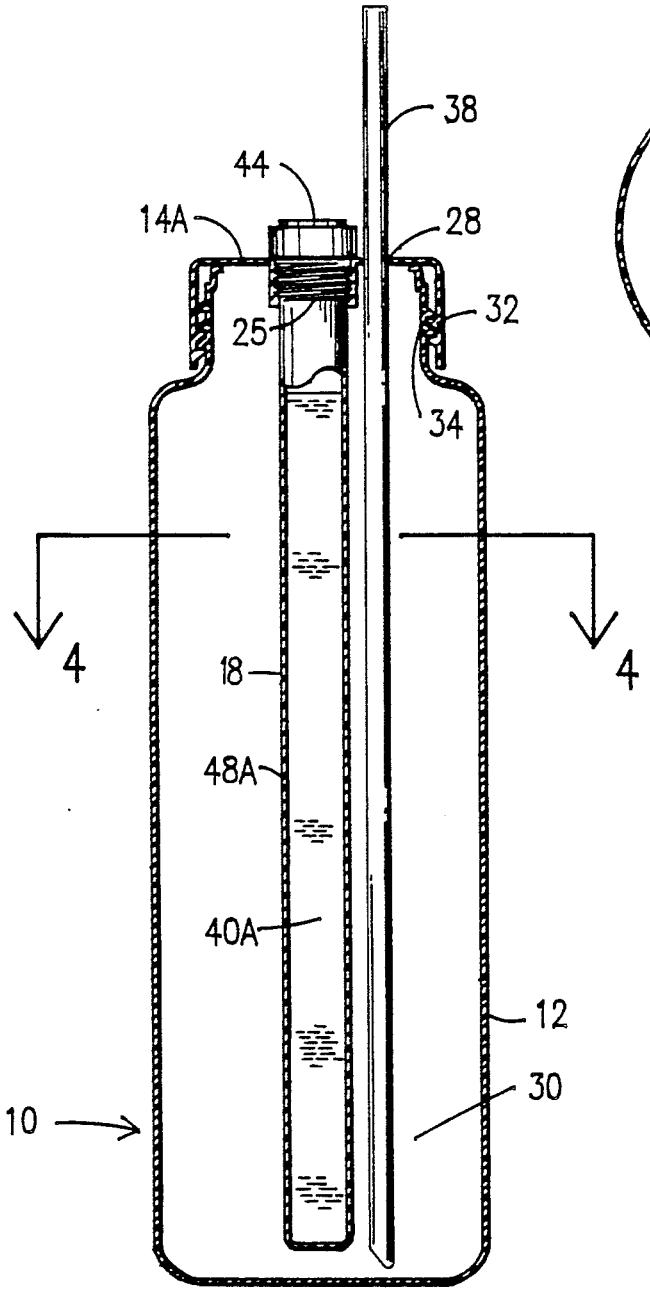
FIG. 3 is a sectional view in elevation of a container with a cylindrical insert containing a freezable solution threaded into a bore in a cap of the container.
Figure 4:
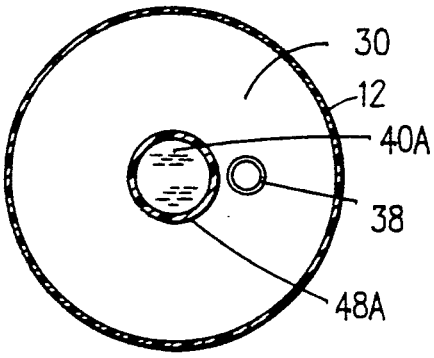
FIG. 4 is a cross-sectional view along line 4—4 of FIG. 3.
Figure 5:
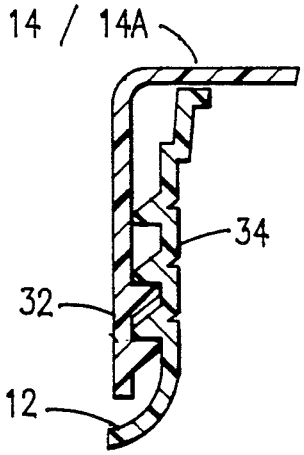
FIG. 5 is an expanded view of the threaded fitting of a cap member to an exterior side wall of a container.
Figure 6:
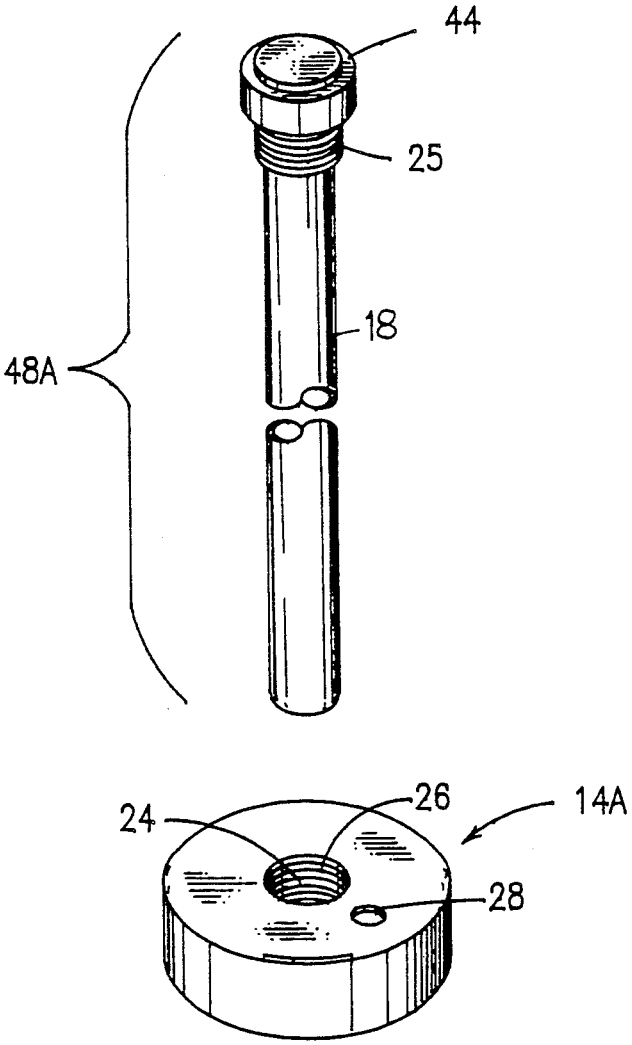
FIG. 6 is a perspective view of the cap shown in FIG. 3 without the straw and the freezable insert ready to be screwed in place.
Figure 7:
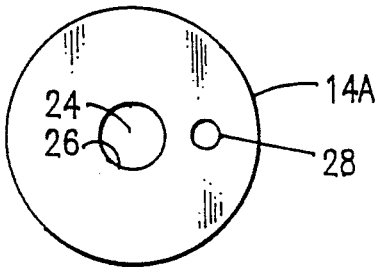
FIG. 7 is a top plan view of the cap shown in FIG. 6.

The drinking container 10 shown in FIGS. 1 and 3 has a cylindrical sidewall 12 and a cap 14 or 14A, respectively. The freezable insert tube 48 shown in FIG. 1 has resiliently flexible walls enclosing a space filled with a non-toxic, non-volatile, aqueous solution 40 with a freezing point below the freezing point of water. The top portion 23 of freezable insert 48 is integral with a bottom surface 22 of cap 14. In an alternative embodiment shown in FIGS. 3 - 4 and 6 - 7, the cap 14A has a central bore 24 containing threads 26 for engagement with outer threads 25 in freezable insert 48A. A cap 44 is integral with the cylindrical portion 18 of insert 48A. The cap 44 seals the contents 40A from flowing out of insert 48A. A separate bore 28 in cap 14A accommodates a straw 38 as seen in FIG. 3.

The container 10 has an open interior 30 into which is usually placed a liquid, not shown, such as soda or other soft drink and is capped by cap 14 or 14A which has threads 32 on an inner surface engaging threads 34 on the outer surface of sidewall 12. A vent or bore hole 36 in the top of cap 14 allows a straw 38 to be inserted into the container. The cap 14 or the insert 48A is removed from an empty container 10 and is placed in a freezer to permit the freezable gel 40 or 40A to become a solid. When the freezable gel has frozen, the cap 14 or insert 48A can be screwed back to enclose the container 10. The refrigerant, or freezable gel 40 or 40A is preferably a non-toxic, non-volatile, aqueous mixture or solution having a freezing point below 32° F. Preferably, the refrigerant, or freezable gel will have a freezing point of about 15° F. to about 25° F. The insert 48 or 48A is hermetically sealed to prevent any flow of freezable gel 40 or 40A out from insert 48 or 48A.

The outer walls of the insert 48 or 48A are a resiliently flexible plastic to provide for expansion of the freezable gel. Insert 48 or 48A filled with the freezable gel 40 or 40A, respectively has a slight space when the freezable gel 40 or 40A is at room temperature so that when it freezes the expansion will encompass the remaining area of insert 48 or 48A. The types of aqueous gels or aqueous solutions that can be used with this invention include phenols such as ethylene glycol and propylene glycol. Additionally, the freezable gel 40 or 40A can be an aqueous solution of urea having a freezing point of between 17 and 25° F. The urea solution also can contain a small amount of a crystal slip agent such as propylene glycol. A preferred freezable gel is an aqueous solution of from about 15 to 20% urea by weight, based on the total weight of the solution and from about 0.5 to about 3% by weight of a crystal slip agent such as propylene glycol. Water makes up the remainder of the solution.

The exterior surface of container 10 can be a plastic or a polyurethene foam material as is customarily used for drinking containers. The cap 14 or 14A is a stiff plastic such as polyvinyl chloride or an ethylene copolymer.

As seen in FIG. 1, the cap member 14 is integral with the descending freezable insert tube 48. The cap 14 or insert 48A can be removed and placed in a freezer for freezing of the gel 40 or 40A. The freezable gel 40 or 40A can be repeatedly refrozen and reused each time the container 10 is filled with liquid.

An 0-ring can be included along an inner surface of cap 14 or 14A to more completely seal to container 10.

Other materials well known in the art can be substituted for the plastics employed in the invention for the container and end capping members and insert. Equivalent freezable gels can be substituted for the gels set forth above.

Having thus described the invention, what is claimed and desired to be secured by Letters Patent is:

1. A drinking container having a cylindrical side wall, integral bottom and removable cap comprising the cap having a freezable insert attached and descending from the cap into the interior of the container, the insert having resiliently flexible walls enclosing a non-toxic, nov-volatile, aqueous solution with a freezing point below the freezing point of water, the freezable insert being removable from the container for freezing of the solution and being repositioned inside the container after freezing the cap having threads around an interior surface of an annular flange depending downwardly from a top annular surface of the cap, the cap threads engaging to complimentary threads on an outer annular surface of a top portion of the cylindrical side wall, the cap threads and complimentary threads sealing the cap member to the cylindrical top portion when engaged together, the freezable insert being attached to the cap by exterior threads on an upper portion of the freezable insert engaged to threads within a central bore on the cap, the freezable insert being removable from the cap for freezing of the contents by unscrewing the freezable insert from the central bore of the cap, and the cap having an eccentric bore adjacent the central bore for receipt of a means for withdrawing fluid from the container.

2. The drinking container according to claim 1 wherein the freezable insert is permanently sealed to prevent egress of the solution.

* * * * *